United States Patent [19]

Zimmer

[11] Patent Number: 4,552,778

[45] Date of Patent: Nov. 12, 1985

[54] METHOD OF AND APPARATUS FOR APPLYING A VISCOUS MEDIUM TO A SUBSTRATE

[76] Inventor: Johannes Zimmer, Ebentaler Strasse 133, A-9020 Klagenfurt, Austria

[21] Appl. No.: 614,417

[22] Filed: May 25, 1984

[30] Foreign Application Priority Data

May 25, 1983 [AT] Austria ..... 1911/83

[51] Int. Cl.[4] ..... B05D 1/26; B05D 3/12; B05C 3/04; B05C 11/10

[52] U.S. Cl. ..... 427/445; 118/410; 118/415; 118/612; 118/694; 427/244; 427/369

[58] Field of Search ..... 427/244, 373, 356, 358, 427/445, 369; 101/120, 366; 118/406, 410, 411, 415, 694, 612

[56] References Cited

U.S. PATENT DOCUMENTS

| | | | |
|---|---|---|---|
| 2,474,254 | 6/1949 | Kauffman | 101/120 |
| 3,921,521 | 11/1975 | Kudlich | 101/120 |
| 3,969,999 | 7/1976 | Zimmer | 101/120 |

*Primary Examiner*—Evan K. Lawrence

*Attorney, Agent, or Firm*—Karl F. Ross; Herbert Dubno

[57] ABSTRACT

A viscous medium such as a fabric treatment foam is applied to a fabric web by a distributing device extending across the continuously moving web. The foam is pressurized in a first stage and delivered over a long pipe to a distributing chamber of the device where it is distributed over the entire width of the web. The foam is then admitted into a compartment in which it can form a column surmounted by a float to establish a lower second pressure stage and at this lower pressure the foam passes to a pressure generator which forces the foam from a slot-like orifice at a third pressure higher than the second pressure.

17 Claims, 8 Drawing Figures

METHOD OF AND APPARATUS FOR APPLYING A VISCOUS MEDIUM TO A SUBSTRATE

FIELD OF THE INVENTION

The present invention relates to a method of and to an apparatus for applying a viscous medium to a substrate and, more particularly, for applying a flowable substance such as a liquid or a foam to a substrate such as a fabric for the dyeing or other treatment thereof.

BACKGROUND OF THE INVENTION

The application of a viscous medium to a substrate, especially to a fabric web, poses a number of problems which have been difficult to solve heretofore. For example, fabric webs upon manufacture may have considerable widths, e.g. of 5 meters and more, and must be treated at high velocities. Especially under these conditions and when comparatively small quantities of the treating medium are to be applied, difficulties are encountered in obtaining a uniform distribution of the medium upon the substrate.

The flowable media with which the invention is concerned primarily are fabric-treatment agents in a viscous liquid state and foams thereof, e.g. for dyeing and other fabric treatment purposes.

In recent years it has been found to be desirable to apply chemical treatment agents to fabrics in the form of a foam but the application of such foams creates additional problems since there is a tendency for the consistency and other characteristics of the foam to alter with time. It is important, therefore, in such fabric treatment systems to exert efforts to ensure that the consistency and characteristic of the foam which is to contact the fabric do not change with time.

Considerable efforts with only limited success have been directed, therefore, to ensuring that the foam is completely uniform during fabrication and transport to the application region, that aging is prevented and/or aged or altered foam is precluded from being applied to the fabric, and that the foam is uniformly applied to the fabric over the entire width of the web.

OBJECTS OF THE INVENTION

It is the principal object of the present invention to provide an improved method of and apparatus for the application of viscous flowable materials to a wide continuously moving substrate, e.g. a fabric web, whereby the disadvantages of the earlier systems are obviated.

Another object of this invention is to provide a method of and an apparatus for the application of foam and other viscous and sensitive flowable media to a fabric web or other wide continuously moving support, whereby comparatively small quantities of the flowable medium can be applied substantially uniformly over the entire width of the web with minimum aging effects.

SUMMARY OF THE INVENTION

These objects and others which will become apparent hereinafter are attained, in accordance with the present invention, in a method for applying a viscous, sensitive, flowable media to a continuously moving substrate such as a textile web which comprises pressurizing the medium in a first pressure stage, delivering the pressurized medium to an application site, preferably over a long path in which the medium remains confined to ensure its homogeneity and the absence of inclusions or the like which tend to destroy homogeneity, distributing the material over the width of the substrate at this location and subjecting it to a second pressure stage at a pressure less than the first pressure stage and preferably at a pressure below the ultimate application pressure, and feeding the medium over the width of the substrate and the distribution chamber in which it was at the second pressure, with a third pressure.

In other words the medium, usually a foam, is fed to the application site at a first pressure and there distributed over the width of the fabric web with a sutstantially uniform reduced pressure and finally drawn from this distribution chamber and applied to the web at a third pressure higher than the second pressure.

The apparatus for carrying out the invention thus comprises a preparation station or means for the medium which is provided with a first pressure generator whose output is connected to the distribution chamber via a conduit of considerable length and forming the path mentioned previously in which the medium is enclosed. The distribution chamber opens over the entire width of the fabric into the third pressure stage which is likewise formed with a pressure generator.

According to a feature of the invention, the medium is fed to the distribution chamber over the entire width of the fabric. According to an important aspect of the invention, all or part of the second pressure can be applied to the medium in the distribution chamber by loading a column of the medium with a float which can rise or fall with the change in level of the medium in the distribution chamber. Advantageously, this column can also communicate with an outlet which is on the opposite side of the distribution chamber from the inlet of the first pressure stage thereto and which serves to discharge aging medium, the inlet to the third pressurizing stage being provided between this outlet and the location at which the first pressure stage communicates with the distribution chamber.

The method and apparatus of the invention, more fully described below, permit relatively small quantities of aging sensitive media to be applied uniformly over the entire widths of large-width webs, e.g. of fabric, and are highly effective with liquids of a wide variety of viscosities and, especially, foams.

BRIEF DESCRIPTION OF THE DRAWING

The above and other objects, features and advantages of the present invention will become more readily apparent from the following description, reference being made to the accompanying drawing in which.

SUMMARY OF THE INVENTION

The principles of this invention are applicable to the uniform distribution of substantially any viscous flowable medium, e.g. a foam, to substantially any continuously moving relatively wide substrate. In specific terms, I will have reference to a "foam" and to a fabric or textile web and it should be understood that such references are intended to encompass other viscous treating liquids and other continuous substrates to be treated. Furthermore, the invention is suitable for use in the direct application of the medium from the third pressure stage to the substrate or to a transfer roller or other system which in turn applies the medium to the substrate. These modifications being also encompassed in the discussion of all of the embodiments referred to below.

Figure 1:
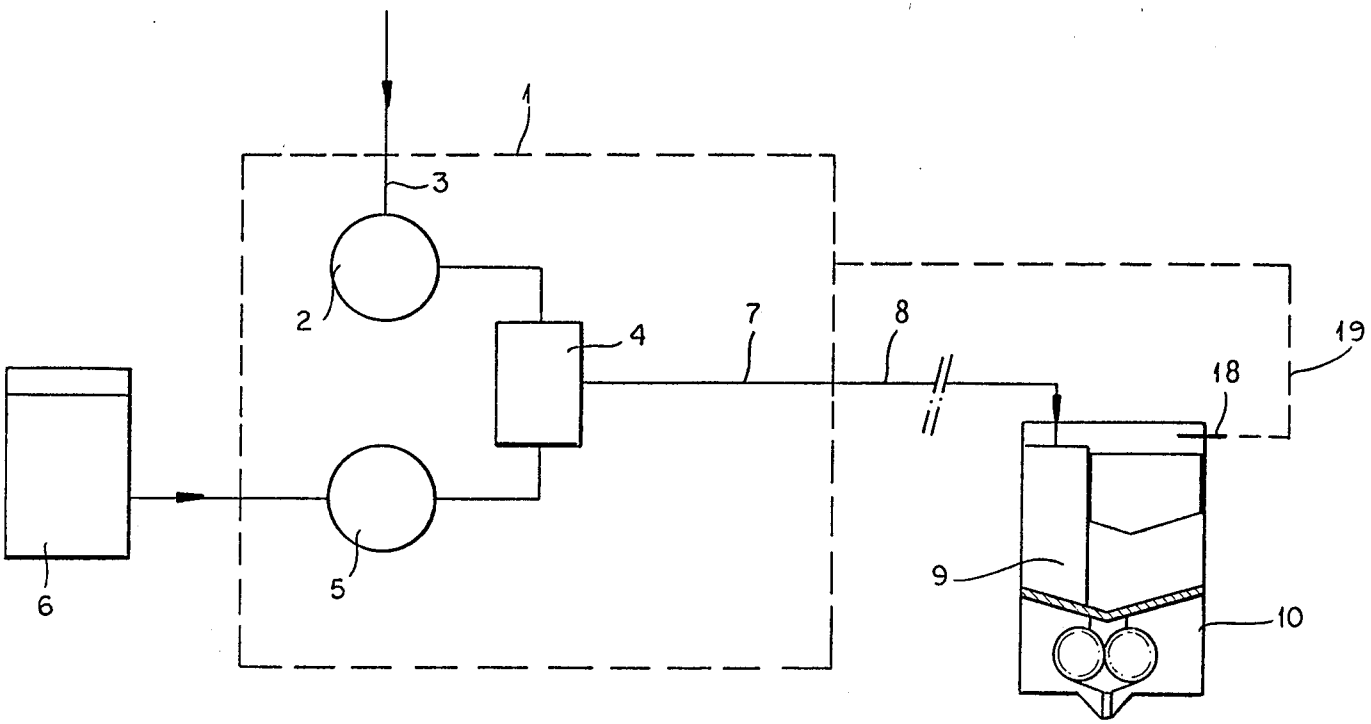
FIG. 1 is a block diagram in part and a diagrammatic section in part illustrating a system for carrying out the method of the invention.

The system of FIG. 1 comprises a first pressure stage 1 which, in this case, also serves for the preparation of a foam adapted to form the medium to be applied to the substrate. The first pressure stage 1 comprises a compressed-air source 3 connected via a pressure-control or air-metering system 2 to a mixing chamber 4. Into this mixing chamber, the foamable liquid is fed from a supply vessel 6 by the pump 5. In the appropriate preparations, the foamable liquid is mixed and foamed with the air metered into the mixing chamber 4 by the controller 2 and the foam is brought to the requisite superatmospheric pressure of the first stage, e.g. 3 to 5 bar.

Naturally, when a viscous liquid rather than a foam is used, the compressed-air source and ontrol and the mixing chamber can be eliminated, and the first stage pressure generated exclusively by the pump 5.

In either case, the medium is fed at the superatmospheric pressure of 3 to 5 bar into and along the conduit 8 which delivers the foam to the distribution chamber 9 of the distributing device 10.

The mixing of the compressed air with the liquid is effected in the mixing chamber 4 statically or dynamically utilizing any conventional foaming technique.

The distribution chamber 9 distributes the supplied foam substantially uniformly over the entire length of the distributing device 10 and hence over the entire width of the substrate or web.

It is important that the conduit 8 have a significant length, preferably 10 meters or more, to ensure that the foam on the discharge end of this conduit will be completely uniform and free from undistributed air inclusions which might interfere with the homogeneity.

Figure 2:
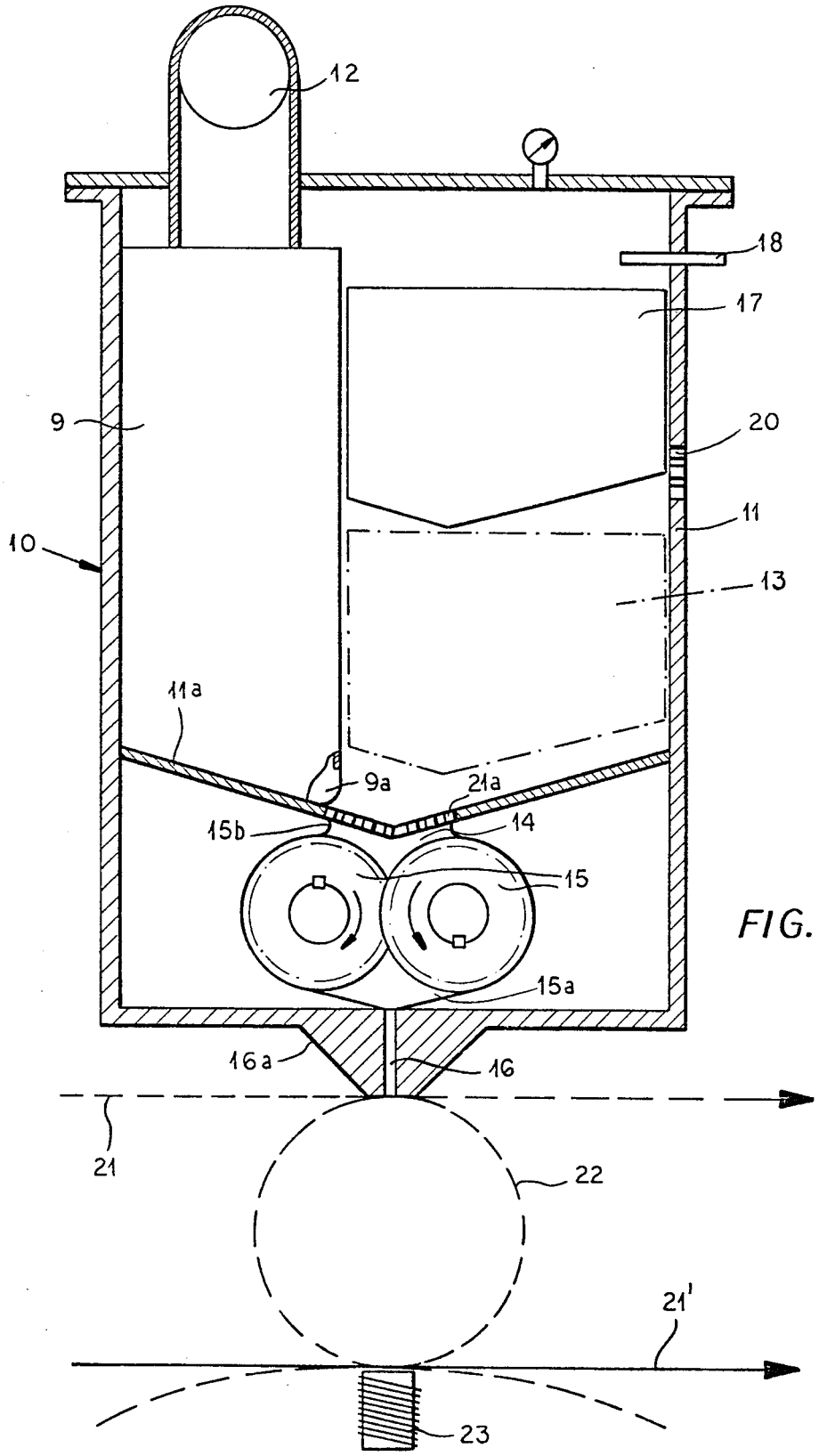
FIG. 2 is a vertical section through a distribution device according to the invention, the distribution device extending perpendicular to the plane of the paper of the drawing over the entire width of the fabric web to be coated.

FIG. 2 shows the distributing device 10 in greater detail. The distributing device 10 comprises an elongated housing 11 extending over the full width of the substrate or web and subdivided internally into a number of compartments including the distribution chamber 9 and a column or compartment 13 communicating with the distribution chamber 9 at an outlet 9*a* of the latter proximal to the inlet to the third pressurization stage. The inlet to the third pressurization stage is formed by a plurality of perforations 21*a* in a partition 11*a*. The outlet 9*a* opens at the base of the column 13 in which a float 17 is vertically shiftable, e.g. from its dot-dash position to its solid-line position shown.

Figure 3:
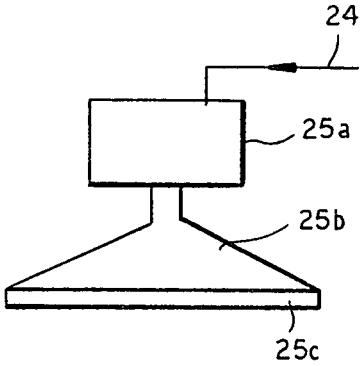
FIGS. 3–6 are diagrams illustrating various possibilities for distributing the foam to the distribution chamber of the distributing device.
Figure 4:
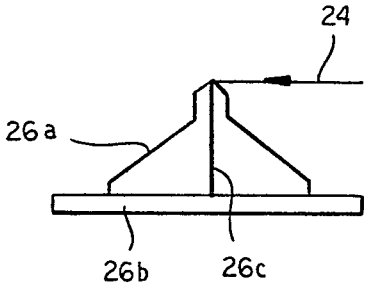

The distribution chamber 9, shown as a simple box configuration can have any one of the configurations illustrated in FIGS. 3–6. In these Figures, the inlet in each case is shown at 24. In the modification of FIG. 3, the inlet opens into a box-like compartment 25*a* which communicates with a spreading funnel 25*b* opening at a single slit-like outlet 25*c* all along the length of the chamber of column 13. In the embodiment of FIG. 4, the distribution chamber comprises a downwardly diverging structure 26*a* opening at the slit-like outlet 26*b* and subdivided internally by a partition 26*c* for more uniform distribution of the viscous material from the inlet.

Figure 5:
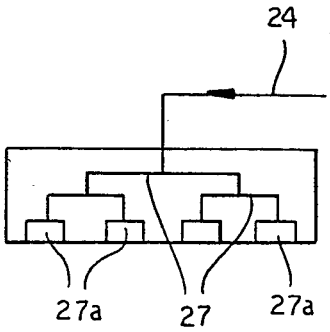
Figure 6:
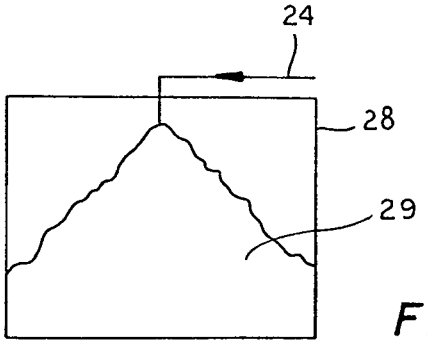

In the embodiment of FIG. 5, the inlet 24 opens into a manifold system 27 which communicates a number of outlets 27*a* spaced along the length of the compartment 13 whereas in FIG. 6, the material 29 can be seen to spread automatically over the entire length of the distribution chamber in the compartment 28.

In general, therefore, the distribution chamber can be provided with one or more funnels, one or more distribution passages, which can be of greater or lesser fineness, and/or baffles designed to permit the uniform distribution of the conical flow of the material from the outlet 24.

Reverting to FIG. 2, it can be seen that once the material flows from the end 12 of the pipe 8 into the distribution chamber 9, it passes at the lower end of the latter, uniformly over the entire width of the distributing device 10 into the compartment or column 13 in which a supply of the medium is built up and the length of this supply is, of course, equal to the working length of the distributing head 10 and hence the width of the fabric web.

From this supply compartment 13, therefore, the foam can enter the compartment 14 below the partition 11*a* and can be forced by the toothed or milled rollers 15 through the slit-like orifice 16 extending the full width of the web and the length of the distributing device 10. The rollers 15 form a further pressure generator and thus develop the pressure of the third stage between these rollers and the orifice 16. Aprons 15*a* and 15*b* can be provided to guide the material.

Naturally, this third pressure stage need not utilize toothed or milled rollers but can be provided with any other suitable pressure generator adapted to develop the application pressure. Naturally, it will be understood that the first foam-generating or supply stage and the subsequent stages can have their pressures independently controlled and established.

In the supply chamber 13 the medium, i.e. the foam or some other liquid, is distributed over the entire working width in an approximately pressureless or substantially pressureless state. This is the second pressure stage and it has been found that this stage should apply some slight pressure on the inlet to the third stage. This slight pressure can be supplied by the hydrostatic head of the column of the medium in compartment 13.

The pressure of the second stage, therefore, need only be sufficient to ensure uniform intake of the foam or liquid to the third stage at least about equal to the intake pressure of the third stage. With more highly flowable liquids, this pressure can be supplied by the hydrostatic head whereas with more highly viscous liquids and foams, it may be supplied with auxiliary mechanical means, such as the float or by the application of pressure above the column by appropriate means. Only in the third pressure stage is the medium at the requisite working pressure for application to the fabric or to the transfer roll.

The float 17 can have the shape of a bar as shown and can substantially close the top of the column. It can act as a piston which moves upwardly and downwardly and the seal between the walls of a housing 11 and the float can be made by the foam itself.

The weight of the float applies a slight superatmospheric pressure to the foam and levels any nonuniformity in the distribution of the foam over the width of the fabric. The float can be replaced for foams of different densities so that the desired load or weight is applied.

The float not only ensures uniform movement of the foam into the third pressure stage, but also excludes the trapping of air and provides a mechanical control member whose level variation represents changes in the foam supply and foam demand which can operate a sensor 18 shown schematically in FIG. 1.

The sensor 18 is connected at 19 to the first pressurization stage 1 as shown diagrammatically in FIG. 1 so that the feed of the foam can be reduced when excess buildup of the column of foam feed can be increased should the column level drop excessively. This sensor can be a bar detector which is actuated mechanically by or by proximity to the float 17 capacitively.

At an upper part of the housing 11 openings 20 are provided in a wall of the column 13 positioned so that when these openings are cleared by the float 17, aging excess foam can be discharged or withdrawn. The discharge of aging foam can be effected by applying for a brief period a signal to the first stage 1 to supply a larger quantity of foam than required for the demand, thereby displacing aging foam upwardly and out through the orifices 20. This foam can then be collected in a vessel (not shown).

The freshest foam, of course, is supplied directly to the inlet to the third stage and aging foam bypassing the inlet to the third stage can be discharged in the manner described and automatically or periodically, (e.g. every 10 seconds) as may be desired. The perforations 21*a* prevent foreign material from entering the chamber 14.

As can be seen from FIG. 2, moreover, the orifice 16 can apply the foam directly to a fabric web which can be pressed against the underside of the orifice nozzle 16*a* by a support roller 22, a magnetic system 23 being provided to supply the pressure. Alternatively the roller 22 can be utilized as a transfer roller and the fabric web 21' applied against the latter, in which case the nozzle 16*a* can open directly into contact with the transfer roller.

Figure 7:
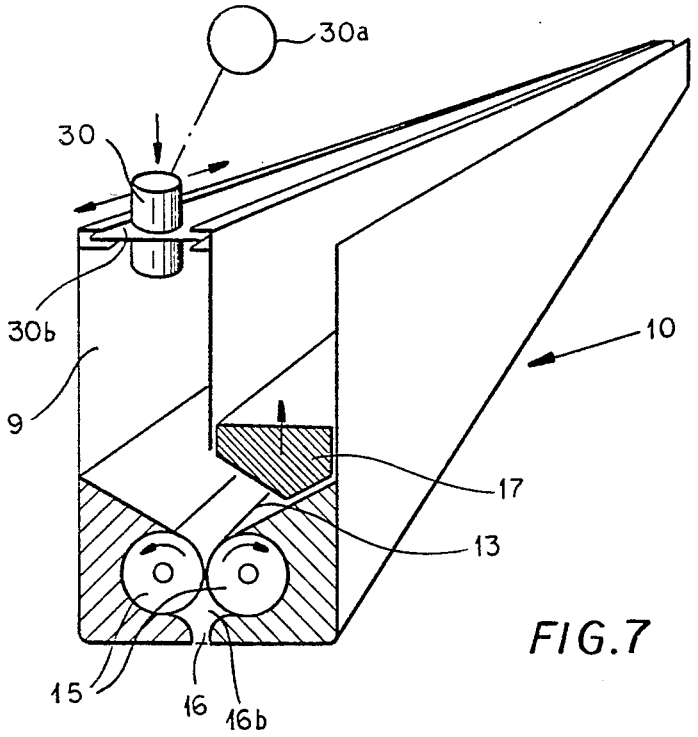
FIGS. 7 and 8 are diagrammatic perspective views, partially in section, of embodiments for applying the viscous medium from above and applying the viscous medium from below, respectively, to a substrate or to a transfer roll for application to a substrate.

FIG. 7 shows an embodiment of the invention which differs from that of FIG. 2 in that the outlet 30 of the pipe 8 is shiftable over the length of the distributor device 10 and hence across the width of the web to deposit the viscous material more uniformly in the distribution chamber 9. The back and forth movement for distributing the foam can be effected by means of a drive 30*a*, shown only diagrammatically, and controlled in accordance with the viscosity and flow parameters. The cover 30*b* of the inlet opening for the compartment 9 can be moved together with the outlet 30. The free surface of the column of foam is covered by the float 17.

In this embodiment, moreover, the compartment 9 and the compartment 13 open directly into the nip between the rollers 15 which act as a gear pump to deliver the foam to the compartment 16*b* in which the third pressure stage is generated for discharge of the foam through the orifice 16.

Figure 8:
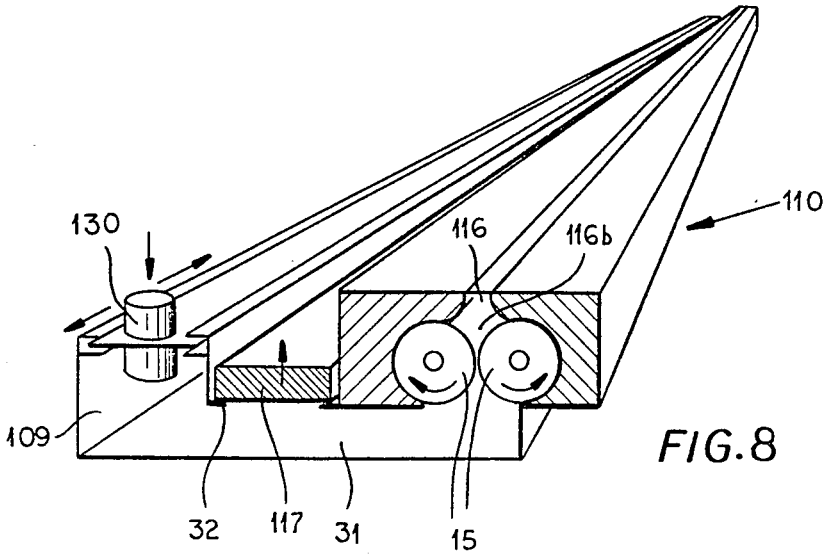

The embodiment of FIG. 8 represents an arrangement whereby similar principles are utilized to deliver the foam via a moving outlet 130 of the pipe 8 to an L-shaped distribution compartment 109 which opens laterally into a compartment 31 formed with an opening 32 into which a column of the foam can rise and in which this column is covered by the float 117. Both the column and the distribution chamber 109 open toward the nip of the toothed rollers 15 which form a gear pump delivering the foam to the compartment 116*b* from which the foam flows through the slot-like orifice 116 upwardly to the underside of a fabric web or onto a transfer roller in contact with such a web. The principle of operation of this distributing device 110 is thus similar to the device 10 of FIG. 7.

One of the advantages of the system of the invention is that with increasing viscosity of the medium, the stability of distribution appears to be improved within limits and that unusually small amounts of foam material can be applied uniformly and with great precision to a fabric web. Thus the present system provides improvements in the art in minimizing losses in material, simplifying control of the distribution and quantity of the material which can be applied to the web and reducing the losses of material from aging or the like. Other means than that shown can be used to respond to the level of the foam or other medium in the column when, for example, the float is not utilized.

I claim:

1. A method of applying a viscous medium to a continuously moving wide substrate, comprising the steps of:

pressurizing said medium to an elevated first pressure in a first pressure stage;

delivering said medium at an elevated pressure of said first pressure stage to a distribution chamber extending across the width of said substrate;

admitting said medium from said distribution chamber into a compartment maintained at a second pressure less than said first pressure in a second pressure stage over the width of said substrate;

withdrawing said medium from said compartment at said second pressure and pressurizing it to a higher third pressure in a third pressure stage; and dispensing the medium at said third pressure over the width of said surbstrate for application thereto, said first, second and third pressures being adjustable independently of one another.

2. The method defined in claim 1 wherein said second pressure is at least about equal to the intake pressure of said third stage.

3. The method defined in claim 1 wherein said second pressure is controlled at least in part by the level of said medium in said compartment.

4. The method defined in claim 3 wherein said second pressure is controlled in response to a characteristic of said medium.

5. A method of applying a viscous medium to a continuously moving wide substrate, comprising the steps of:

pressurizing said medium to an elevated first pressure in a first pressure stage;

delivering said medium at an elevated pressure of said first pressure stage to a distribution chamber extending across the width of said substrate;

admitting said medium from said distribution chamber into a compartment maintained at a second pressure less than said first pressure in a second pressure stage over the width of said substrate;

withdrawing said medium from said compartment at said second pressure and pressurizing it to a higher third pressure in a third pressure stage;

dispensing the medium at said third pressure over the width of said substrate for application thereto; and controlling said second pressure by applying a float of selected weight to said medium in said compartment.

6. An apparatus for applying a viscous flowable medium to a continuously moving wide substrate, said apparatus comprising:

means defining a first pressure stage for pressurizing said medium to a first pressure;

an elongated distributing device extending across said substrate and having a distributing chamber connected to said first pressure stage for receiving said medium therefrom and distributing said medium over the entire width of said substrate;

a compartment receiving said medium from said distributing chamber in said distributing device and extending across the entire width of said substrate for maintaining said medium at a second pressure less than said first pressure and constituting a second pressure stage, said second pressure being controlled by means for applying a force to the top of a column of said medium in said compartment; and a pressure generator on said device for receiving said medium from said compartment over the entire width of said substrate for pressurizing said medium to a third pressure higher than said second pressure for discharging said medium at said third pressure from said device onto said substrate.

7. The apparatus defined in claim 6 wherein said chamber communicates with said pressure generator substantially at the junction between said chamber and said compartment.

8. The apparatus defined in claim 7 wherein said means for applying a force to said medium comprises a float mounted on said column and rising and falling therewith.

9. The apparatus defined in claim 8 wherein said float has a weight selectable in accordance with a property of said medium.

10. The apparatus defined in claim 8 further comprising control means for said first stage responsive to the level of said column in said compartment to regulate the flow of foam to said first stage.

11. The apparatus defined in claim 10 wherein said control means is responsive to the position of said float.

12. The apparatus defined in claim 10 wherein a wall of said compartment is provided with an outlet for the discharge of aged medium.

13. The apparatus defined in claim 6 wherein said distributing chamber is elongated across the width of said substrate, further comprising an outlet from said first stage communicating with said distributing chamber and shiftable across the width of said substrate for distributing said medium therein.

14. The apparatus defined in claim 6 wherein said device has an L-shaped configuration with said chamber opening laterally into said compartment and said pressure generator being provided at a location of said compartment oposite the chamber.

15. The apparatus defined in claim 6 wherein said first stage is provided with means for foaming a liquid to produce a foam constituting said medium.

16. The apparatus defined in claim 6 wherein said pressure generator includes a pair of geared rollers.

17. The apparatus defined in claim 16 wherein said pressure generator has a slot-shaped orifice for discharging said medium extending across the width of said substrate.

* * * * *